United States Patent [19]

Keene

[11] 4,228,719

[45] Oct. 21, 1980

[54] PLECTRUM FOR STRINGED MUSICAL INSTRUMENTS

[76] Inventor: George W. Keene, P.O. Box 333, Rochelle, Ill.

[21] Appl. No.: 60,399

[22] Filed: Jul. 25, 1979

[51] Int. Cl.[3] ..... G10D 3/16

[52] U.S. Cl. ..... 84/322; D17/20

[58] Field of Search ..... 84/320–322; D17/20

[56] References Cited

U.S. PATENT DOCUMENTS

| | | | |
|---|---|---|---|
| 3,319,505 | 5/1917 | Galetzky | 84/322 |
| 3,439,570 | 4/1969 | Lee | 84/322 X |

FOREIGN PATENT DOCUMENTS

| | | | |
|---|---|---|---|
| 483856 | 6/1952 | Canada | 84/322 |

*Primary Examiner*—Lawrence R. Franklin

*Attorney, Agent, or Firm*—Leydig, Voit, Osann, Mayer & Holt, Ltd.

[57] ABSTRACT

A pick or plectrum having a plurality of rounded corners each adapted for selectively engaging the strings of a musical instrument and each having a degree of flexibility different from that of the others. Resilient plastic is molded into a single piece with holes adjacent at least two of the playing corners with the holes being of different sizes so that the playing corners have different flexibility.

4 Claims, 7 Drawing Figures

PLECTRUM FOR STRINGED MUSICAL INSTRUMENTS

BACKGROUND OF THE INVENTION

This invention relates to plectrums or picks which are used in the playing of stringed musical instruments such as guitars, mandolins and the like. When thus employed the pick is held between thumb and index finger of one hand of the musician and used to pluck the strings of the instrument thereby effecting in the strings vibrations which produce sound.

The tone produced by a stringed musical instrument when plucked by a pick held in the player's hand will vary, among other factors, with changes in the physical properties of the pick employed. Seeking to produce different musical results by this method, a number of variations in the structure of picks have been attempted so as to alter the stiffness and resiliency of them.

These structural variations have included constructing picks from a number of different materials, either alone or in combination with each other. Also, picks having different thicknesses and striking points of different shapes have been used. Further a hole or holes have been made through the pick itself in the area between that held between the player's finger and thumb and the tip or point which actually contacts the strings.

The musician who would wish to vary the tone of his music by altering the flexibility or resiliency of the pick in his hand normally has been able to do so by two means. He could either vary the manner in which a given pick was held or equip himself with several picks each having different mechanical properties.

A third alternative would be to use a pick having a plurality of plucking corners with each different plucking corner having a different flexibility or resiliency. This has been accomplished by molding in plastic a pick whose several plucking points have different thickness.

SUMMARY OF THE INVENTION

The main object of this invention is to provide a single plectrum having a plurality of corners capable of being used selectively to engage the strings of a musical instrument where the corners are formed in a novel manner to have different degrees of flexibility each from the other and thereby is capable of being used to produce different tones on the same stringed instrument.

Another object of this invention is to provide a new and improved plectrum or pick with the characteristics described above which is made of common materials and is of a single piece and thickness thereby being quite easy to manufacture.

Additionally, this invention has as its objective that of providing a pick with all of the characteristics described above while affording the user a firm grip and enhanced control.

A more detailed object is to achieve the foregoing by forming holes adjacent at least two of the corners with the holes being of different size and thereby giving their respective corners different degrees of flexibility.

DETAILED DESCRIPTION OF THE PREFERRED EMBODIMENTS

Figure 1:
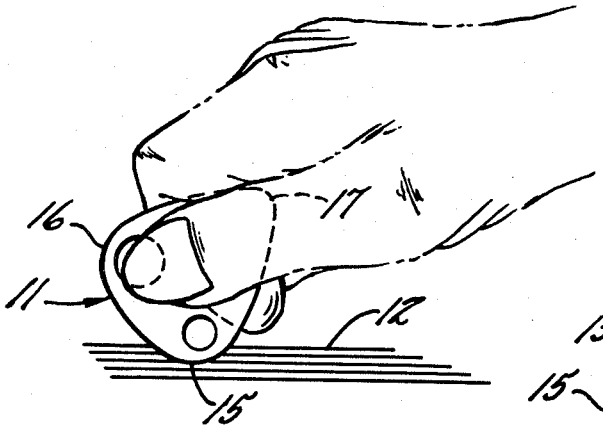
FIG. 1 is a view of a plectrum incorporating the invention and held in the right hand as it engages the strings of a musical instrument.
Figure 2:
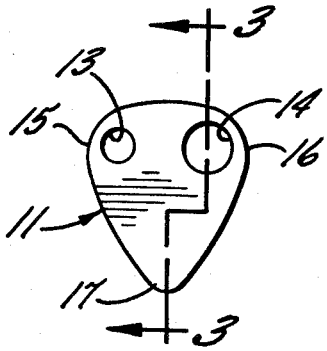
FIG. 2 is a plan view of the plectrum shown in FIG. 1.
Figure 3:
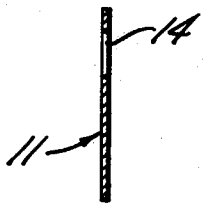
FIG. 3 is a section view taken along the line 3—3 in FIG. 2.
Figure 4:
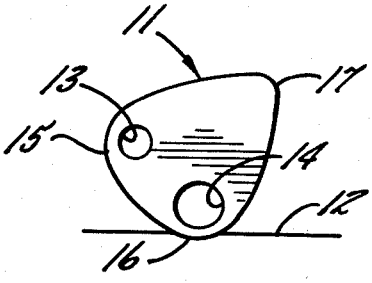
FIG. 4 is a view of the plectrum of FIG. 1 engaging the string of a musical instrument with a plucking corner other than the one used in FIG. 1.

While the invention will be described in connection with certain preferred embodiments, it is to be understood that it is not intended to limit the invention to those particular embodiments. On the contrary, it is intended to cover all alternatives, modifications and equivalents as may be included within the spirit and scope of the invention as defined by the appended claims.

As shown in the drawings for purposes of illustration, a triangular pick 11 (FIGS. 1–4) molded from a single piece of resilient plastic is formed with two rounded corners 15 or 16 and a sharper corner 17. Any of the corners may be employed to engage the strings of a musical instrument while the plectrum is held between the users thumb and forefinger by body of the pick.

In accordance with the present invention, the pick 11 is constructed in a novel manner so that each of the corners has a different flexibility thereby permitting the musician to use the corner having the flexibliity best suited for his purpose. To achieve this holes are formed in the pick adjacent at least two of the corners to make those corners more flexible and one hole is larger than the other thereby giving the corners different degrees of flexibility.

In the embodiment illustrated in FIGS. 1 through 4, there are two holes 13 and 14, the smaller hole 13 being adjacent the corner 15 and the larger 14 being adjacent the corner 16. Thus, the corner 17 is the least flexible, the corner 16 is the most flexible and the corner 15 has an intermediate flexibility. As seen from FIG. 3, this varying flexibility is achieved with a pick which is uniform in thickness. Further, regardless of which corner of the pick is being used, the thumb and finger of the musician overlap one of the holes 13 and 14 and this improves his grip of the pick.

Figure 5:
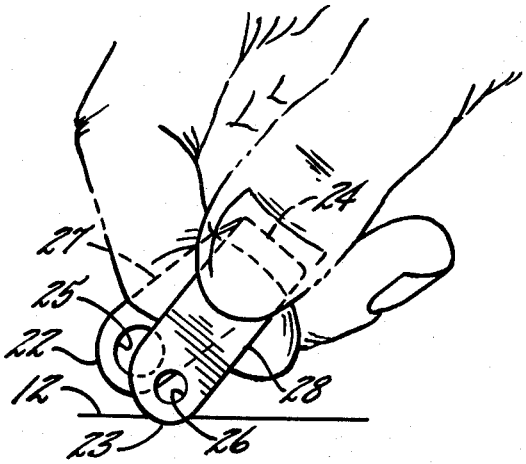
FIG. 5 is a view of modified form of the invention with the plectrum held in the right hand as it engages the strings of a musical instrument.
Figure 6:
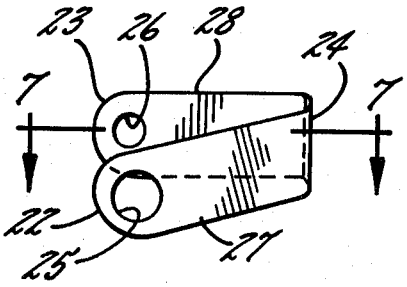
FIG. 6 is a plan view of the plectrum of FIG. 5.
Figure 7:
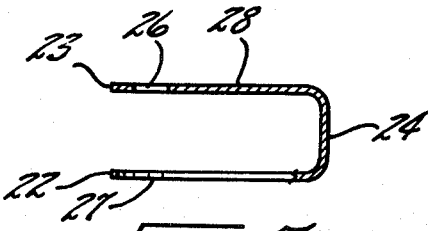
FIG. 7 is a sectional view taken along line 7—7 of FIG. 6.

A modified form of plectrum embodying the principle of this invention is shown in FIGS. 5–7. Referring to FIG. 6, the plectrum in this form is a single U-shaped piece of molded resilient plastic. Its two rounded plucking corners 22 and 23 are at the ends of legs 27 and 28 respectively which are connected to opposite ends of a base portion 24. As seen in FIG. 7, the plectrum in this configuration is of generally uniform thickness.

In order to employ this form of plectrum (see FIG. 5), it may be held so that the rounded corner 23 is used to engage the string 12 of a musical instrument in which case the leg 28 is held between the thumb and index finger while the base extends behind the inner surface of the last joint of the index finger. The other leg whose plucking corner 22 is not in use passes between the index and middle fingers. The plectrum is reversed in the hand to use corner 22 and the leg 27 is held. To facilitate the selective use of one of the two plucking corners, the legs 27 and 28 are not strictly parallel but are canted in relation to each other so that, when viewed with the base 24 to the right as in FIG. 6, the closer member 27 is angled downward in relation to the distant member 28. The plectrum affords the user enhanced control due to the gripping action upon the leg not in use which passes between the index and middle fingers.

As in the case of the first form, the modified plectrum employs holes so as to achieve a different degree of flexibility in each playing corner. The holes are of different size, the larger hole 25 rendering the playing corner 22 more flexible than the playing corner 23 adjacent to which is the smaller hole 26.

It will be observed that a plectrum constructed in accordance with the invention gives the musician a choice of the flexibility of the corner he uses. Moreover, the gripping of the plectrum is improved and the plectrum is comparatively simple and inexpensive to manufacture.

I claim:

1. A plectrum for a stringed musical instrument comprising a single piece of resilient molded plastic material, said piece including at least two rounded corners each adapted to be used selectively for engaging the strings of the instrument while a portion of the piece other than the corner being used is held by hand, and a plurality of holes formed in said piece, one adjacent each of said corners, said holes being of different sizes whereby the flexibility of the portions of the piece adjacent each of said corners is individually different.

2. A plectrum for a stringed musical instrument comprising a single piece of resilient molded plastic material, said piece being generally triangular in shape and having rounded corners adapted to be used selectively for engaging the strings of the instrument while a portion of the piece other than the corner being used is held by hand, a first hole of predetermined size formed in said piece adjacent a first one of said corners thereby to give the portion of the piece adjacent said first corner a preselected degree of flexibility correlated with the size of said hole, and a second hole of predetermined size smaller than the size of said first hole and formed in said piece adjacent a second one of said corners thereby to give the portion of the piece adjacent said second corner a preselected lesser degree of flexibility correlated with the size of said second hole.

3. A plectrum for a stringed musical instrument comprising a single piece of resilient molded plastic material, said piece being generally U-shaped and having a base and first and second legs spaced from each other and projecting outwardly from opposite ends of said base, a rounded corner portion formed on the outer end of each of said legs and adapted to be used selectively for engaging the strings of the instrument while said piece is held adjacent said base, a first hole of predetermined size formed in the corner portion of said first leg thereby to give the corner portion a preselected degree of flexibility correlated with the size of said first hole, and a second hole of a predetermined size smaller than the size of said first hole and formed in the corner portion of said second leg thereby to give the corner portion of the second leg a preselected lesser degree of flexibility correlated with the size of said second hole.

4. A plectrum according to claim 3, in which the legs are not parallel, but are slightly canted from each other as they project from the base, thereby to further facilitate the selective use of a given leg in singly engaging the strings of a musical instrument.

* * * * *